US007366430B2

(12) United States Patent
Shishikura et al.

(10) Patent No.: US 7,366,430 B2
(45) Date of Patent: Apr. 29, 2008

(54) ROTARY-TYPE DEVELOPING DEVICE AND IMAGE FORMING APPARATUS

(75) Inventors: Shunichiro Shishikura, Kanagwawa (JP); Shigeru Tsukada, Kanagawa (JP); Naoya Yamasaki, Kanagawa (JP); Masayuki Aratake, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/354,127

(22) Filed: Feb. 15, 2006

(65) Prior Publication Data

US 2006/0291878 A1 Dec. 28, 2006

(30) Foreign Application Priority Data

Jun. 27, 2005 (JP) ..... P.2005-185953

(51) Int. Cl.
*G03G 15/00* (2006.01)

(52) U.S. Cl. ..... 399/9; 399/27; 399/43; 399/227

(58) Field of Classification Search ..... 399/27, 399/227, 9, 43
See application file for complete search history.

(56) References Cited

U.S. PATENT DOCUMENTS 5,918,092 A * 6/1999 Hama ..... 399/227
6,201,939 B1 * 3/2001 Yamamoto et al. ..... 399/99
2006/0067738 A1 * 3/2006 Ohara et al. ..... 399/227

FOREIGN PATENT DOCUMENTS

| | | |
|---|---|---|
| JP | 4-349480 | 12/1992 |
| JP | 7-225513 | 8/1995 |
| JP | 2000-227707 | 8/2000 |
| JP | 2000-231255 | 8/2000 |
| JP | 3170500 B | 3/2001 |
| JP | 3170501 B | 3/2001 |
| JP | 2001-134044 | 5/2001 |
| JP | 2001-166557 | 6/2001 |
| JP | 2001-175131 | 6/2001 |

* cited by examiner

*Primary Examiner*—David M. Gray
*Assistant Examiner*—Bryan Ready
(74) *Attorney, Agent, or Firm*—Morgan, Lewis & Bockius LLP

(57) ABSTRACT

An image forming apparatus includes a rotary unit having a plurality of development devices provided around a rotary shaft, the development device having a constituent unit, wherein: a plurality of the development devices sequentially move to a development position, where the development devices oppose an image carrier by rotation of the rotary unit, and a development device located at the development position develops an electrostatic latent image on the image carrier; each of the plurality of development devices has a state detection unit that detects at least one of a state of the development device and a state of a constituent unit of the development device; and the state detection unit of each of the development devices performs state detection when the development device having the state detection unit is located at the development position.

9 Claims, 5 Drawing Sheets

| | ① | ② | ③ | ④ | ⑤ | ⑥ | ⑦ |
|---|---|---|---|---|---|---|---|
| NUMBER OF OVERLAPPED STOPS OF DEVELOPMENT DEVICES | 4 | 3 | 1 | 2 | 2 | 1 | 3 |
| | YMCK | YMK | C | YK | MC | K | YMC |

ROTARY-TYPE DEVELOPING DEVICE AND IMAGE FORMING APPARATUS

BACKGROUND OF THE INVENTION

1. Field of the invention

The present invention relates to an image forming apparatus which enables printed output of a visible image on a recording medium by means of developing an electrostatic latent image on an image carrier through use of a development device.

2. Background Art

An image forming apparatus compatible with a color image has recently become widely prevalent. Some pieces of image forming apparatus compatible with a color image have four development devices assigned to respective color components of YMCK, and a rotary (revolving body) unit having the development devices disposed around a rotary shaft of the rotary unit. In the image forming apparatus having such a configuration, the respective development devices integrally rotate in association with rotation of the rotary unit, whereby the development devices sequentially move to a development position where the development device faces a photosensitive drum which serves as an image carrier. Consequently, after having developed an electrostatic latent image on the photosensitive drum as a toner image, the development device located at the development position transfers the toner image to an intermediate transfer body, or the like. These operations are sequentially repeated such that the toner images formed by the respective development devices are superposed one on top of the other on the intermediate transfer body or the like, so that a transfer image corresponding to the color image is formed on the intermediate transfer body or the like.

In the electrophotographic image forming apparatus, the electrostatic latent image on the photosensitive drum is generally developed as a toner image. Accordingly, the concentration of toner, the amount of remaining toner, and the like greatly affect the image quality of a formed image. In view of this, an image forming apparatus, which has a rotary unit and is compatible with a color image, has hitherto been proposed to detect and monitor—through use of a custom-designed sensor, or the like—the concentration of toner, the amount of remaining toner, a determination as to whether or not the development device is attached to a predetermined position within the rotary unit, a determination as to whether or not a toner cartridge, which is a constituent unit of the development device, is attached, and the like, whereby the image quality of the formed image can be maintained favorable. Specifically, proposed configurations are as follows: Namely, a custom-designed sensor, or the like, is disposed at a fixed position proximate to the outer circumferential surface of, e.g., the rotary unit. The state of the development device opposing the fixed position is detected. Further, the development device in the rotary unit is provided with a sensor for detecting the concentration of toner, or the like. Exchange of a signal with the sensor or supply of power is performed by an optical communication unit, to the sensor through use of a current. In view of limitations on securing of motor space or power supply, a drive source, such as a motor disposed outside the rotary unit, imparts driving force—which is used for causing the development devices in the rotary unit to perform development operation—solely to the development device, which has rotationally moved to and come to stop at the development position and remains stationary.

However, an image forming apparatus having a related-art rotary unit subjects the development devices located outside the position, where an electrostatic latent image on the photosensitive drum is developed, to detection of a state of the development device, such as the concentration of toner, the amount of remaining toner, and attachment/detachment of the development device, or detection of a state of a constituent unit of the development device such as attachment/detachment of a toner cartridge, as well as to acquisition of a signal pertaining to a result of detection. Specifically, the development devices located outside the development position are subjected to detection of a state of the development device or detection of a state of a constituent unit of the development device.

The state of a development device that is in the course of developing an electrostatic latent image cannot be detected. Sufficient detection accuracy cannot always be acquired in connection with a physical quantity whose highly-accurate information can be detected by means of detecting the state of the development device in a driven state, such as the concentration of toner.

In some image forming apparatus equipped with a rotary unit, pitches between the development devices on the outer circumference of the rotary unit are nonuniform. When the image forming apparatus is compatible with formation of a monochrome image as well as formation of a color image, the amounts of consumed toner of YMCK color components do not necessarily become uniform. In relation to toner of a color component which is consumed in large amounts, an increase in the volume of the toner cartridge in the developing machine is effective for lessening the frequency of replenishment of toner.

However, when the development devices are arranged at nonuniform pitches, the development position is the only position where all the development devices always stop. Therefore, when state detection is performed at a position other than the development position, a custom-designed sensor, a sensing signal exchange unit, or the like, is arranged at a plurality of locations in order to detect the states of respective development devices. Alternatively, when none of the development devices are located at the development position, there may arise a necessity for stopping the rotary unit. In short, operation required by the development devices arranged at nonuniform pitches may result in complication of the configuration of the image forming apparatus, a drop in productivity relating to image formation, or the like.

SUMMARY OF THE INVENTION

The present invention has been made in view of the above circumstance and provides an image forming.

Specifically, according to an aspect of the present invention, there is provided an image forming apparatus including a rotary unit having a plurality of development devices provided around a rotary shaft, the development device having a constituent unit, wherein a plurality of the development devices sequentially move to a development position, where the development devices oppose an image carrier by means of rotation of the rotary unit, and a development device located at the development position develops an electrostatic latent image on the image carrier, and wherein:

each of the plurality of development devices has a state detection unit that detects at least one of a state of the development device and a state of a constituent unit of the development device; and the state detection unit of each of the development devices performs state detection when the development device having the state detection unit is located at the development position.

BRIEF DESCRIPTION OF THE DRAWINGS

Embodiments of the present invention will be described in detail based on the following figures, wherein.

DETAILED DESCRIPTION OF THE EMBODIMENTS

An image forming apparatus according to the present invention will be described hereinbelow by reference to the drawings.

Description of Example Basic Configuration

Figure 1:
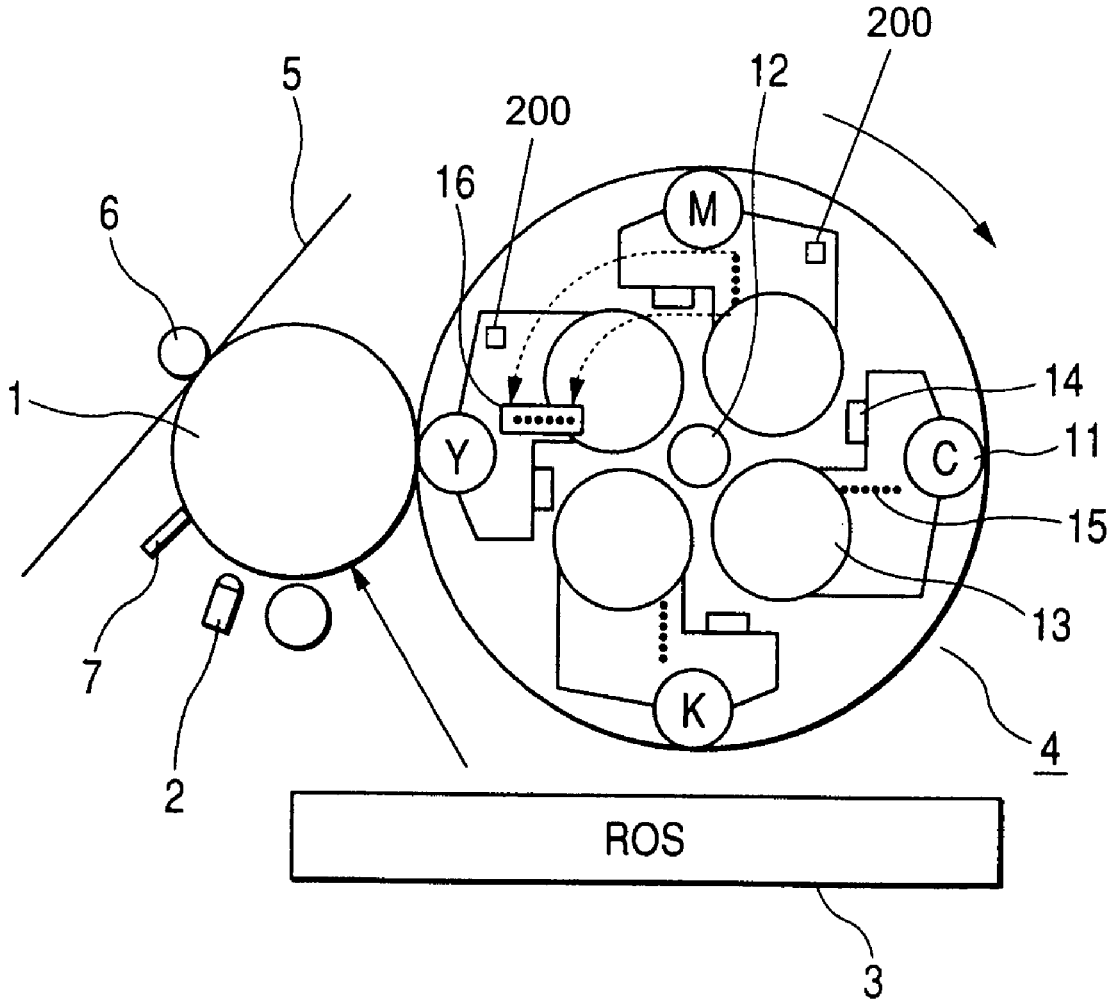
FIG. 1 is a descriptive view showing the principal configuration of an example image forming apparatus of the present invention.

FIG. 1 is a descriptive view showing the principal configuration of an example image forming apparatus according to the present invention. As illustrated, the image forming apparatus to be described herein includes an image carrier 1 formed from a photosensitive drum, or the like; an electrifying device 2 for electrifying the image carrier 1; an ROS (Raster output Scanner) 3 which writes an electrostatic latent image on the image carrier 1 through exposure; a rotary unit 4 having a plurality of development devices for developing an electrostatic latent image on the image carrier 1 as a toner image; a transfer device 6 for transferring the toner image on the image carrier 1 onto an intermediate transfer belt 5; and a cleaning device 7 for removing the toner remaining on the image carrier 1.

Of these elements, the rotary unit 4 has four development devices 11 assigned to respective Y, M, C, K color components so as to enable formation of a color image, and has the development devices 11 disposed around a rotary shaft 12. As a result of the rotary unit 4 rotating around the rotary shaft 12, the respective development devices 11 rotate in an integrated fashion. Rotation of the rotary unit 4 is performed by an unillustrated drive source such as a motor, and rotational driving of the rotary unit 4 is controlled by a rotation control unit, such as a motor controller or the like, which is also unillustrated. Specifically, under drive control of the rotation control unit, the rotary unit 4 starts rotation and halts rotation at a desired position. In relation to the technique for controlling driving of the rotary unit 4 performed by the rotation control unit, it is better to utilize a known technique, and therefore its explanation is omitted.

Each of the development devices 11 attached to the rotary unit 4 employs toner which is, e.g., a well-known two-component developing agent for developing the electrostatic latent image on the image carrier 1. Therefore, each of the development devices 11 has a toner cartridge 13, as a constituent unit of the development device, for storing toner assigned to any of color components Y (yellow), M (magenta), C (cyan), and K (black). In order to facilitate replenishment of toner, the toner cartridge 13 is configured to be removably attached to the development device 11. The development device 11 is also configured so as to be removably attached to the rotary unit 4 in order to facilitate maintenance of the development device. The mechanism that enables removable attachment of a toner cartridge is realized by utilization of the well-known technique. Therefore, its explanation is omitted.

The respective development devices 11 attached to the rotary unit 4 are provided around the rotary unit 4 such that an arrangement pitch on the circumference of the rotary unit 4 becomes uniform. Specifically, the development devices 11 attached to the rotary unit 4 are four in number, and hence the circumferential length of the rotary unit 4 is split into four uniform lengths by means of these development devices 11.

The pitches among the development devices 11 arranged on the circumferential of the rotary unit 4 do not always need to be uniform, and the development devices 11 may be provided at nonuniform pitches on the rotary unit 4.

In general, the image forming apparatus compatible with a color image also has the potential for forming a monochrome image as well as a color image. For this reason, the amount of consumed toner of Y, M, C, K color components is not necessarily uniform. In relation to toner of color components which are consumed in large amounts, an increase in the volume of toner cartridge in the developing machine is effective for lessening the frequency of replenishment of toner. Therefore, the volume of the toner cartridge 13 for the development device 11 assigned to a color component whose toner is consumed in a large amount: specifically, toner of K color component, can be conceived to be made larger than that of the development devices 11 assigned to the other color components.

As mentioned above, when the volume of the toner cartridge 13 of the development device 11 assigned to the K-color component is made large, pitches at which the development devices 11 attached to the rotary unit 4 become nonuniform.

Moreover, regardless of whether the respective development devices 11 are arranged on the circumference of the rotary unit 4 at uniform pitches or nonuniform pitches, each of the development devices 11 provided on the rotary unit 4 is arranged to be driven at the development position. Here, the term "development position" is a position which opposes the image carrier 1 and where the respective development devices 11 sequentially move and stop for developing the electrostatic latent image on the image carrier 1. Namely, the development device 11 located at the development position is driven at the development position, to thus develop the electrostatic latent image on the image carrier 1 at that development position. Driving of the development device 11 also employs an auger (of vane type or the like) provided for transporting toner in the toner cartridge 13.

However, when the electrostatic latent image on the image carrier 1 is developed as the toner image, the concentration of toner, the amount of remaining toner, and the like greatly affect the image quality achieved through image formation. For this reason, each of the development devices 11 set in the rotary unit 4 is provided with a state detection unit 14 for detecting either the state of the development device 11 or the state of a constituent unit of the development device 11.

The state of the development device 11 detected by the state detection unit 14 refers to the state of a matter which affects operation for developing an electrostatic latent image. Specifically, the state includes the concentration of toner used for developing an electrostatic latent image, the amount of remaining toner, attachment/detachment of the development devices 11 to/from the rotary unit 4, specifics of attribute information stored in the development devices 11, and the like.

As in the case of the state of the development device 11, the state of the constituent unit of the development device 11 detected by the state detection unit 14 refers to a matter which affects the operation for developing an electrostatic latent image. Specifically, the state of the constituent unit includes attachment/detachment of the toner cartridge 13 constituting the development device 11.

The essential requirement for the state detection unit 14 is a sensor which detects at least one of the state of the development device 11 and the state of the constituent unit of the development device 11. Specifically, the state detection unit 14 may be a sensor which detects any one of the above matters or a sensor which detects a plurality of matters in combination.

For instance, if the matter to be detected is the concentration of toner, a permeability sensor is conceived to be used as the state detection unit 14. Further, providing a peak detection circuit in conjunction with the permeability sensor is desirable. The peak detection circuit samples a detection signal output from the permeability sensor, and a peak value of the signal which arises at the cycle of an auger is taken as a detection result of the concentration of toner. The peak detection circuit is not formed solely from a hardware configuration, but may include a software configuration for sampling a plurality of pieces of data corresponding to a plurality of cycles of the auger and then computing peak values by means of arithmetic operation. Since details of the permeability sensor and those of the peak detection circuit can be embodied by utilization of known techniques, their details are omitted here for brevity. As a matter of course, the concentration of toner maybe detected by utilization of a known technique other than the permeability sensor and the peak detection circuit.

Moreover, for instance, when the matter to be detected is the amount of remaining toner, a transmission optical sensor is conceived to be used as the state detection unit 14. Specifically, each of the development devices 11 is provided with a transmission optical sensor, and transparent windows of the toner cartridges 13 are provided in the respective development devices 11, and reflection surfaces provided on inner wall surfaces of the cartridges can be viewed through the transparent windows. The amount of toner remaining in the toner cartridge can be detected in a non-contact manner. Moreover, vibrations of a sensing face can be detected by means of a commonly-utilized remaining quantity sensor. Use of a sensor—which detects presence or absence of a contacting element in the form of electrical resistance by utilization of a phenomenon of vibration being prevented by presence of a powder (toner) contacting the sensing face—is also conceivable. Specifically, the amount of remaining toner may also be detected by utilization of a known technique other than the transmission optical sensor.

For instance, when the matter to be detected is attachment/detachment of the development device 11 or attachment/detachment of the toner cartridge 13, a reflection optical sensor is conceivable to be used as the state detection unit 14. Specifically, a reflection optical sensor is conceived to be provided in each of the development devices 11; and each of the development devices 11, or a wall surface where each toner cartridge 13 is to be mounted, which are to become objects of sensing, is conceived to be provided with a reflection plate, to thus detect, in a noncontact manner, attachment/detachment of the respective development devices 11 or the toner cartridges 13. Another well-known technique may also be utilized for detecting attachment/detachment of the development device or the toner cartridge.

When the matter to be detected is specifics of attribute information about the development device 11, means for exchanging data with memory belonging to each development device 11 or the toner cartridge 13 thereof is conceivable to be used as the state detection unit 14. An electromagnetic communication unit (an antenna unit) is conceivable to be provided as a data exchange unit. As a result of a radio wave emitted from the communication unit being converted into energy, data are conceived to be exchanged, in a noncontact manner, with respect to memory belonging to the development device 11, thereby detecting the attribute information stored in the memory. The attribute information stored in memory includes manufacturing information, such as a manufacturing lot of toner stored in the toner cartridge 13, the amount of toner filled in the toner cartridge, the date of manufacture of toner in the toner cartridge, a shape factor of toner, a mean particle size, an initial physical characteristic (an electrifying characteristic), and the like. These pieces of manufacturing information have already been written in memory upon shipment of a product from the factory. In addition, the attribute information includes history information, such as the number of pages having undergone image formation performed by the image forming apparatus (a developing machine or a toner cartridge), a driving time, and temperature-humidity history. These pieces of history information are assumed to be written into memory by way of the communication unit, as appropriate, according to an operating condition of the image forming apparatus. Exchange of data by way of the communication unit is implemented by utilization of a well-known technique. Therefore, its explanation is omitted here.

In order to supply power to the state detection unit 14 such as that mentioned above, each of the development devices 11 is provided with a first electrode 15 which is brought into electrical conduction with the state detection unit 14 provided in conjunction with the respective development device 11 for outputting the result of detection performed by the state detection unit 14 to the main body of the image forming apparatus.

A second electrode 16, which pairs up with the first electrode 15, is provided on the main body of the image forming apparatus.

When the first electrode 15 and the second electrode 16 oppose each other in close positions so as to pair up with each other, exchange of an operation voltage or data pertaining to the result of detection (hereinafter referred to simply as "signal exchange") can be performed between the electrodes as in the case of the above-described electromagnetic communications unit. Exchange of a voltage or data is also be implemented by utilization of the well-known technique of direct physical contact between the first and second electrodes 15 and 16 or a non-contacting transceiver-type of signal communication between the first and second electrodes 15 and 16, and hence its explanation is omitted here.

Only one second electrode 16 is provided so as to pair up with the first electrode 15 belonging to the development device 11 located at the development position. Namely, the second electrode 16 is for exchanging a signal with the state detection unit 14 of the development device 11 located at the development position with any one of the plurality of development devices 11 remaining located in the development position. Consequently, each of the development devices 11 is provided with the state detection unit 14. Even when the first electrodes 15 remain in electrical conduction with the respective state detection unit 14, only the first electrode 15 belonging to the development device 11 located at the development position exchanges a signal with the second electrode 16.

Description of Example Processing Operation

Characteristic example processing operation of the image forming apparatus of the present invention will now be described.

Figure 2B:
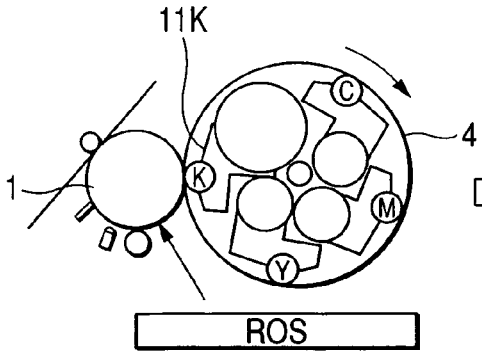
FIGS. 2A to 2E are descriptive views showing a specific example of state transition in characteristic example processing operation of the image forming apparatus of the present invention.
Figure 2C:
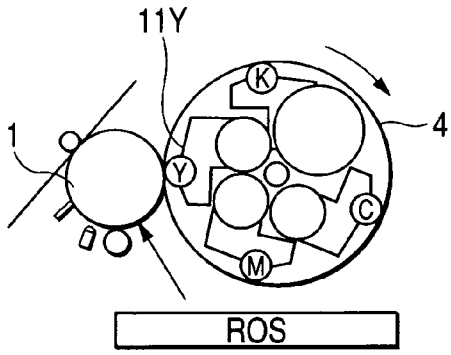
Figure 2A:
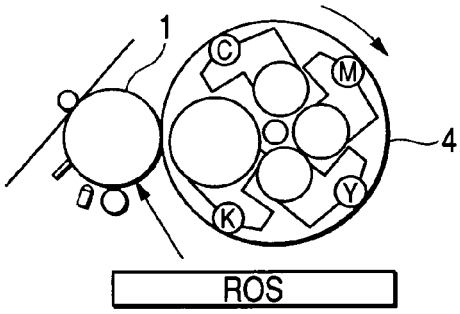
Figure 2D:
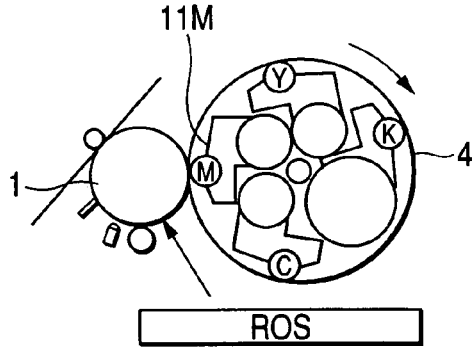
Figure 2E:
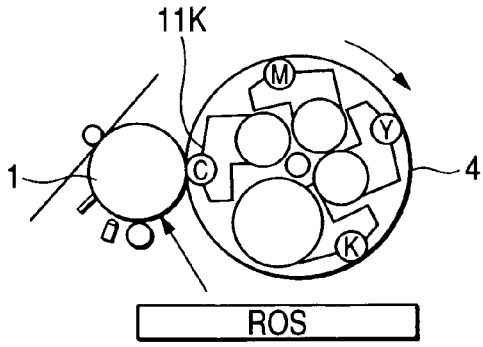
Figure 3:
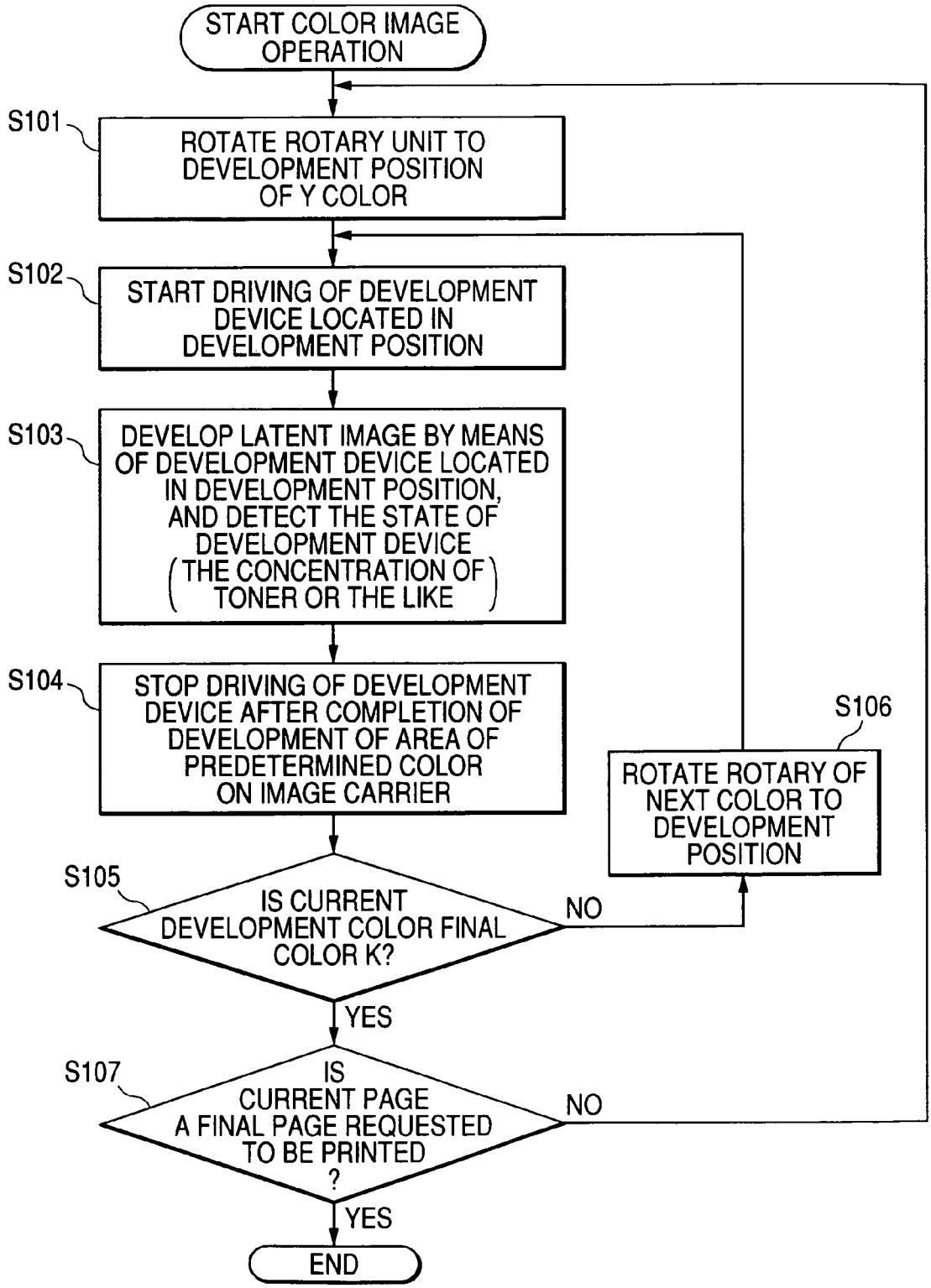
FIG. 3 is a flowchart showing an outline of the procedures of characteristic example processing operation.

FIGS. 2A to 2E are descriptive views showing specific example state transition effected by a characteristic example processing operation of the image forming apparatus of the present invention, and FIG. 3 is a flowchart showing an outline of the procedures of the example processing operation. Descriptions are provided by means of taking, as an example, processing operation performed in a case where the development devices 11 are arranged at nonuniform pitches. No substantial discrepancy exists between the case where the development devices 11 are provided at a uniform pitch, such as that shown in FIG. 1, and the case where the development devices 11 are arranged at nonuniform pitches, and hence explanation for the case where the development devices are provided at uniform pitches is omitted.

During halt of the image forming apparatus to be described herein, the rotary unit 4 remains stationary at a home position where none of the development devices 11 oppose the image carrier 1, in order to lessen the burden imposed on the image carrier 1 or the like (see FIG. 2A).

When image forming operation is started subsequently, the rotary unit 4 starts rotation in, e.g., a clockwise direction in FIGS. 2A to 2E, pursuant to drive control performed by the rotation control unit, and the rotation is continued until the development device 11K assigned to the K-color component reaches the development position (see S101 in FIG. 3). When the development device 11K assigned to the K-color component has moved to the development position and stopped at the development position while opposing the image carrier 1 (see FIG. 2B), driving of the development device 11K located at that development position is started (see S102 shown in FIG. 3), whereby an electrostatic latent image on the image carrier 1 is made visible in the form of a toner image (see S103 in FIG. 3).

In conjunction with operation for developing an electrostatic latent image, the development device 11K located at the development position also performs state detection by means of the state detection unit 14 of the development device 11K (see S103 in FIG. 3). Since the development device 11K is located at the development position, the second electrode 16 pairs up with the first electrode 15 of the development device 11K and can exchange a signal therewith. Consequently, power is supplied to the state detection unit 14 of the development device 11K by way of the pair of electrodes 15, 16. The state detection unit 14 detects the state of the development device 11K or that of the toner cartridge 13K, and exchanges data pertaining to the result of detection. The result of state detection performed this time is delivered by way of the second electrode 16 to the control section that controls operation of the entire image forming apparatus and is used for maintaining image quality pertaining to image formation.

After operation for developing the electrostatic latent image of K-color component has been completed, driving of the development device 11K situated at the development position is halted (see S104 in FIG. 3), and operation for developing the electrostatic latent image of the K-color component is completed. The toner image formed on the image carrier 1 by means of the above developing operation is transferred onto the intermediate transfer belt 5 by means of the transfer device 6.

After operation for developing the electrostatic latent image has been completed, a determination is made as to whether or not the color component of the completed operation for developing the electrostatic latent image is a final color component; specifically, whether or not the color component of the electrostatic latent image is a final color C of the color components which are merged in sequence of, e.g., KYMC (see S105 in FIG. 3). If the color component is not the final color component, the rotary control means of the rotary unit 4 resumes its rotation and continues rotation until the development device 11 assigned to the next color component reaches the development position (see S106 in FIG. 3). For instance, if operation for developing the electrostatic latent image of the K-color component has been completed, the development device 11Y assigned to the Y-color component moves to the development position by means of resumption of rotation of the rotary unit 4. Thus, the development device comes to a halt while facing the image carrier 1 located at the development position (see FIG. 2C). The development device 11Y, which is located at the development position and assigned to the Y-color component, is repeatedly subjected to the above-described processing operations (see S102 to S106 shown in FIG. 3).

The image forming apparatus repeats the above-described processing operations until all of the color components undergo the processing operations. Namely, after completion of the operation for developing the electrostatic latent image of the Y-color component, similar processing is successively performed in relation to the M-color component (see FIG. 2D). Further, the C-color component is also subjected to similar processing (see FIG. 2E). At that time, rotation of the rotary unit 4, rotation of the image carrier 1, transfer of an image on the intermediate transfer belt 5, and the like, are performed at timing when the toner image of a preceding color and the toner image of the next color properly overlap each other on the intermediate transfer belt 5.

After operation for developing electrostatic latent images as toner images and transfer and merging of the toner images on the intermediate transfer belt 5 have been completed in connection with all of the color components, a determination is made as to whether or not a page whose image has been formed is a final page of the pages whose images are requested to be formed (see S107 in FIG. 3). The above-described round of processing operations are repeatedly performed until all of the pages, whose images are to be formed, finish undergoing processing (see S101 to S107 in FIG. 3).

As has been described above, in the image forming apparatus of the present embodiment, the state detection unit 14 of each of the development devices 11 detects the state of the development device 11 when the development device 11 is located at the development position. Consequently, the state detection unit 14 can detect a state during the course of the development device 11 performing operation for developing an electrostatic latent image. Sufficient detection accuracy can be acquired in connection with a physical quantity whose highly-accurate information can be detected by means of detecting the state of the development device 11 in a driven state, such as the concentration of toner.

Moreover, in the image forming apparatus of the present embodiment, the essential requirement is to detect the state of each of the development devices 11 at only the development position. Accordingly, regardless of whether the respective development devices 11 are arranged on the circumference of the rotary unit 4 at uniform pitches or nonuniform pitches, each of the development devices 11 always comes to a stop at the development position. Hence, there is no necessity for a configuration for detecting the state of a development device 11 when the development device is at a position other than the development position, so that complication of the configuration of the apparatus for effecting state detection can be prevented. Moreover, when none of the development devices 11 is situated at the development position, there is no necessity for stopping rotation of the rotary unit 4 in order to perform state detection. Thus, occurrence of a drop in productivity relating to image formation can be prevented.

Consequently, in the image forming apparatus of the present embodiment, the state of the development device 11 or that of the toner cartridge 13 is detected with sufficient detection accuracy, thereby enabling formation of a superior image. Even in such a case, complication of the configuration of the apparatus or a drop in productivity pertaining to image formation can be avoided.

In the image forming apparatus of the present embodiment, the second electrode 16 is provided for exchanging a signal between the state detection unit 14 in the development device 11 located at the development position and any one of the plurality of development devices 11 being located at the development position. Specifically, each of the development devices 11 is provided with the first electrode 15, and the first electrode 15 of the development device 11 stopped at the development position pairs up with the second electrode 16, to thus exchange a signal between the first and second electrodes.

Thereby, in the image forming apparatus of the present embodiment, the state detection unit 14 can detect the state of the development device 11 located at the development position. Moreover, the state detection unit 14 is provided along with each of the development devices 11. However, in the vicinity of the development position, only one second electrode 16 should be provided at a position where the electrode pairs up with the first electrode 15 of the development device 11 located at the development position, and there is no necessity for arranging another constituent component, such as a sensor. Consequently, even if limitations are imposed on a space in the vicinity of, e.g., the development position, the state of the development device 11 located at the development position can be detected.

Moreover, the essential requirement for the first electrode 15 provided in the development device 11 with the development device 11 being located at only the development position is to pair up with the second electrode 16 located in the main body of the image forming apparatus. Limitations are imposed on the positional relationship and distance between the electrodes 15 and 16 to a certain extent. Even when a signal is exchanged between the electrodes 15 and 16 in a noncontact manner, the exchange of a signal can be maintained at high accuracy.

When the pitches among the development devices 11 on the circumference of the rotary unit 4 are nonuniform, the image forming apparatus of the present embodiment is particularly effective.

Figures 4A, 4B:
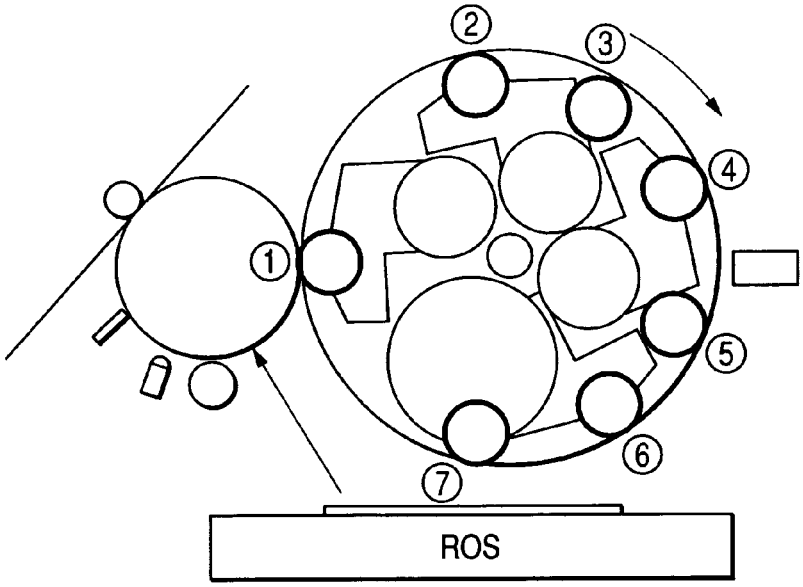
FIGS. 4A and 4B are descriptive views showing a specific example relationship between pitches of development devices and their stop positions.

FIGS. 4A and 4B are descriptive views showing one specific example relationship between the pitches of the development positions and the stop positions thereof. FIG. 4A shows, in an overlapped manner, the positions of the other development devices acquired when any one of the development devices is located at the development position. As is evident from the illustrated example and the table shown in FIG. 4B, when the pitches among the development devices 11 are nonuniform, the only position where all the development devices 11 come to a halt is the development position.

Consequently, particularly when the development devices 11 are set in the rotary unit 4 at nonuniform pitches, the state detection unit 14 detecting the state of the development device 11 located at the development position is very effective for avoiding complication of the configuration of the apparatus or a drop in productivity pertaining to image formation.

In the image forming apparatus of the present embodiment, the state detection unit 14 detects the state of the development device 11 located at the development position or the state of the toner cartridge 13 thereof, and the state detection performed by the state detection unit 14 is also carried out during the course of the development device 11 being driven. Accordingly, sufficient detection accuracy can be acquired in connection with a physical quantity whose highly-accurate information can be detected by means of detecting the state of the development device in a driven state.

Figure 5:
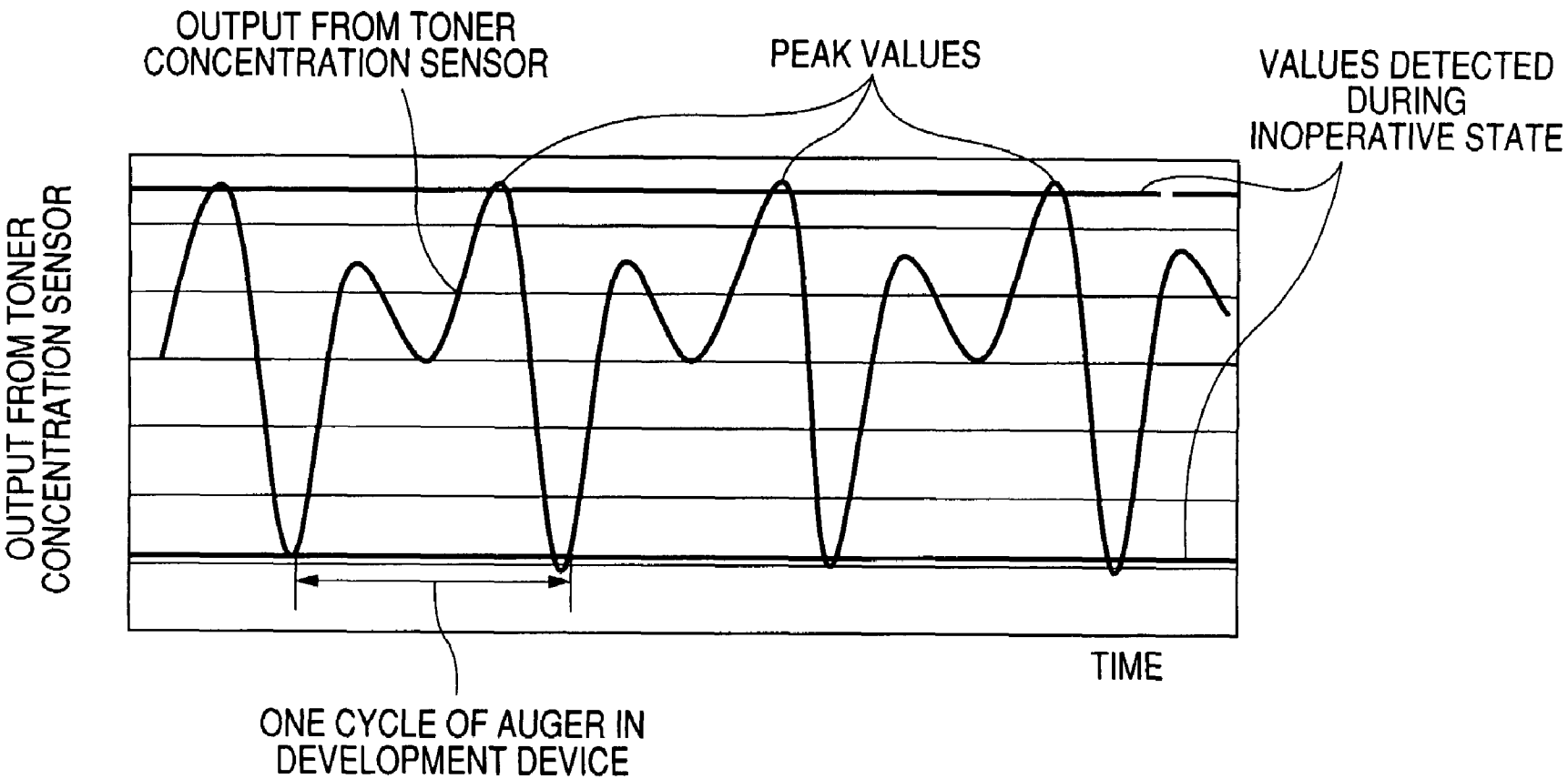
FIG. 5 is a descriptive view showing a specific example output from a sensor acquired when the concentration of toner is detected.

FIG. 5 is a descriptive view showing one specific example output from the sensor when the concentration of toner is detected.

When a matter to be detected is the concentration of toner, the permeability sensor is conceived to be used for effecting detection, as mentioned previously. In this case, when toner is transported by vanes of an auger in the development device 11 that is a subject of detection, the toner located immediately forward of the sensing face of the sensor disappears immediately after the vanes have passed by the position immediately in front of the sensing face of the permeability sensor, so that a moment of the permeability sensor detecting air arises. For this reason, when an attempt is made to detect the state of the development device 11 in its halted state, there may arise a chance of the permeability sensor detecting, e.g., air. Hence, sufficient detection accuracy is not necessarily obtained.

In contrast, so long as state detection is performed during driving of the development device 11, sufficient detection accuracy can be acquired. As illustrated, so long as the development device 11 is in the course of driving, an output from the permeability sensor varies according to the operation cycle of the auger in the development device 11. The sensor output is sampled, and an output peak value developing at the cycle of the auger is detected by means of the peak detection circuit. The thus-sampled peak value is taken as the result of detection of toner concentration, whereby sufficient detection accuracy can be obtained without undergoing the influence of variations in sensor output.

Although the specific preferred embodiments of the present invention have been described by reference to various example configurations and processing operations, the present invention is not limited to the specifics of the embodiments.

For instance, the present embodiment has mentioned the case where, in conjunction with the operation for developing an electrostatic latent image on the image carrier 1 performed by each of the development devices 11, the state detection unit 14 detects the state of the development device 11 that is in the course of operation for developing an electrostatic latent image. However, the present invention is not limited to this embodiment. State detection may be performed separately from operation for developing an electrostatic latent image, so long as the state of the development device 11 located at the development position is detected. Specifically, the rotary unit 4 may perform rotation solely for the purpose of moving the development device 11, which is an object of state detection, or the toner cartridge 13 thereof to the development position and locating the toner cartridge 13 at that development position rather than for the purpose of developing an electrostatic latent image.

In many cases, the image forming apparatus has a prediction unit 200 for predicting occurrence of a change in the state of the development device 11 or the state of the toner cartridge 13 of the development device 11. Specifically, in the case of, e.g., the amount of remaining toner, an available prediction unit 200 retains and accumulates history information about the number of pixels of a processed image, the number of mediums, a cumulative operation time of the apparatus, or the like; predicts the amount of remaining toner on the basis of the history information; and produces an alarm output when the predicted amount of remaining toner falls below the allowable amount of toner. In the case of an image forming apparatus having such a prediction unit 200, a prediction result of the prediction unit 200 is conceived to be one of conditions for performing state detection. Specifically, the state detection unit 14 does not always perform state detection during operation of the apparatus. The state detection unit 14 is conceived to perform state detection operation after the prediction unit 200 has predicted that the state of the development device 11 or the state of the toner cartridge 13 thereof may have changed to a monitoring-required state (e.g., a state when the predicted amount of remaining toner has fallen below the allowable amount in the case of the amount of remaining toner). Since the necessity for the state detection unit 14 to perform state detection operation is not great before the condition changes to the monitoring-required condition, the state detection unit 14 does not perform state detection operation before the monitoring-required state is achieved. As a result, there can be realized an attempt to reduce processing load until the monitoring-required state is achieved.

Moreover, in a case where the prediction unit 200 is provided separately for each of the development devices 11, the state detection unit 14 does not necessarily detect the states of all development devices 11 indiscriminately, but it is also conceivable to cause the state detection unit 14 to detect the state of only the development device that has been predicted to have changed to the monitoring-required state by the prediction unit 200, or the state of a constituent unit of the development device. In such a case, the development devices that are not in the monitoring-required condition do not have to undergo state detection operation performed by the state detection unit 14. By means of limitations being imposed on a target to be subjected to state detection operation performed by the state detection unit 14, there can be realized an attempt to reduce processing load stemming from state detection.

For instance, even the image forming apparatus compatible with a color image operates in a mode for forming a monochrome image. Specifically, there is a case where any one of a plurality of the development devices 11; specifically, only the development device compatible with a K-color component, is compatible with a mode for developing an electrostatic latent image. In that case, it is conceivable to subject only the development device responsible for operation of developing an electrostatic latent image or the constituent unit of the development device; specifically, the development device assigned to the K-color component, to state detection operation performed by the state detection unit 14, rather than to equally subject all the development devices 11 to state detection operation performed by the state detection unit 14. As mentioned above, so long as a limitation is imposed on the target to be subjected to the state detection operation performed by the state detection unit 14, there can be realized an attempt to reduce processing load stemming from state detection operation.

As mentioned above, the present invention is susceptible to modifications of the embodiments within the scope of the gist of the present invention.

According to an aspect of the invention, an image forming apparatus comprises: a rotary unit having a plurality of development devices provided around a rotary shaft, the development device having a constituent unit; wherein: a plurality of the development devices sequentially move to a development position, where the development devices oppose an image carrier by rotation of the rotary unit, and a development device located at the development position develops an electrostatic latent image on the image carrier; each of the plurality of development devices has a state detection unit that detects at least one of a state of the development device and a state of a constituent unit of the development device; and the state detection unit of each of the development devices performs state detection when the development device having the state detection unit is located at the development position.

According ton another aspect of the invention, the image forming apparatus further comprising: an electrode used for exchanging a signal with the state detection unit of the development device located at the development position while any one of the plurality of development devices is located at the development position.

According to another aspect of the invention, the plurality of development devices are arranged on a circumference of the rotary unit at nonuniform pitches.

According to another aspect of the invention, the state detection unit detects the state of the development device or the state of a constituent unit of the development device, which are developing the electrostatic latent image on the image carrier at the development position.

According to another aspect of the invention, the image forming apparatus further comprising: a drive unit that rotates the rotary unit, wherein the drive unit moves the development device to the development position, the state of the development device moved by the drive unit or the state of the constituent unit of the development device moved by the drive unit are to be detected by the state detection unit, the drive unit moves the development device independently from a purpose of developing the electrostatic latent image on the image carrier.

According to another aspect of the invention, the image forming apparatus further comprising: a prediction unit 200 that predicts changes in the state of the development device or the state of a constituent unit of the development device, wherein the state detection unit takes a result of prediction performed by the prediction unit 200 as one of conditions for detecting the state of the development device or the state of a constituent unit of the development device.

In the image forming apparatus having the above-described configuration, each of the development devices attached to the rotary unit has a state detection unit. The state detection unit detects at least one of the state of the development device or the state of a constituent unit thereof. The "state of the development device" refers to the state of a matter which affects operation for developing an electrostatic latent image. Specifically, the state of the development device includes the concentration of toner used for developing an electrostatic latent image or the amount of remaining toner, attachment/detachment of the development device on the rotary unit, and specifics of attribute information stored in and retained by the development device. Likewise, the "state of a constituent unit of the development device" refers to the state of a matter which affects operation for developing an electrostatic latent image. Specifically, the state of a constituent unit includes the state of a toner cartridge constituting the development device, such as attachment/detachment of the toner cartridge. Since the essential requirement is to detect "at least one of the states," detecting any one of the above-described matters and detecting the states of a plurality of matters in combination are acceptable.

Moreover, in the image forming apparatus of the above configuration, the state detection unit of each development device detects the state of the development device when the development device is at the development position. The term "development position" is a position which opposes an image carrier and where the respective development devices sequentially move and stop for developing an electrostatic latent image on the image carrier. Consequently, state detection can be performed even in the course of the development device developing an electrostatic latent image. Moreover, the essential requirement is to perform state detection at only the development position. Hence, there is no necessity for a configuration for detecting the state of a development device when the development device is at a position other than the development position. Moreover, for example, regardless of whether pitches between the development devices disposed on the outer circumference of the rotary unit are uniform or nonuniform, each of the development devices necessarily stops at the development position. Hence, when none of the development devices is situated at the development position, there is no necessity for stopping rotation of the rotary unit in order to perform state detection.

As mentioned above, in the image-forming apparatus of the present invention, the state of the development device is detected when the development device is located at the development position. Hence, state detection can be performed even when the development device is in the course of developing an electrostatic latent image. Sufficient detection accuracy can be acquired in connection with a physical quantity whose highly-accurate information can be detected by means of detecting the state of the development device in a driven state, such as the concentration of toner. Further, the essential requirement is to be able to detect a state at only the development position, and hence there is no necessity for detecting a state at a plurality of locations on the circumference of the rotary unit. The configuration of an apparatus for detecting a state can be prevented from becoming complicated. In addition, regardless of whether pitches among the development devices on the outer circumference of the rotary unit are uniform or nonuniform, the state of the development device is detected when the development device is situated at the development position. Hence, there is no necessity for stopping rotation of the rotary unit for causing the development device to be situated at a position other than the development position, and a drop in productivity relating to image formation is not involved.

Consequently, the image forming apparatus of the present invention enables formation of a superior image by means of detecting the state of a development device, or the like, with sufficient detection accuracy and does not involve, even when the image forming apparatus has a plurality of development devices arranged at nonuniform pitches, complication of the configuration of the apparatus, a drop in productivity relating to image formation, or the like.

What is claimed is:

1. An image forming apparatus comprising a rotary unit having a plurality of development devices provided around a rotary shaft, the development device having a constituent unit; wherein:

a plurality of the development devices sequentially move to a development position, where the, development devices oppose an image carrier by rotation of the rotary unit, and a development device located at the development position develops an electrostatic latent image on the image carrier;

each of the plurality of development devices has a state detection unit that detects at least one of a state of the development device and a state of a constituent unit of the development device; and a prediction unit that predicts changes in the state of the development device or the state of a constituent unit of the development device, wherein the state detection unit takes a result of the prediction performed by the prediction unit as one of the conditions for detecting the state of the development device or the state of a constituent unit of the development device.

2. The image forming apparatus according to claim 1, wherein the plurality of development devices are arranged on a circumference of the rotary unit at nonuniform pitches.

3. The image forming apparatus according to claim 1, wherein the state detection unit detects the state of the development device or the state of a constituent unit of the development device, which are developing the electrostatic latent image on the image carrier at the development position.

4. The image forming apparatus according to claim 1, further comprising:

a drive unit that rotates the rotary unit, wherein the drive unit moves the development device to the development position, the state of the development device moved by the drive unit or the state of the constituent unit of the development device moved by the drive unit are to be detected by the state detection unit, the drive unit moves the development device independently from a purpose of developing the electrostatic latent image on the image carrier.

5. The image forming apparatus according to claim 1, further comprising:

a first electrode associated with each of the state detection units; and a second electrode provided on a main body of the image forming apparatus, wherein the state detection unit of each of the development devices performs state detection only when the development device having the state detection unit is located at the development position and the first electrode associated with the state detection unit is paired with the second electrode.

6. An image forming apparatus comprising:

a rotary unit that includes:

a plurality of development devices provided around a rotary shaft of the rotary unit, each development device including a state detection unit;

a plurality of toner cartridges that store toner and are detachably attached to the development devices, respectively, wherein each state detection unit detects a state of the corresponding development device or a state of the corresponding toner cartridge;

an image carrier;

a main body;

first electrodes that are associated with the state detection units, respectively;

a second electrode provided on the main body; and a prediction unit that predicts the state of each development device or the state of each toner cartridge, wherein:

the plurality of development devices sequentially move as the rotary unit rotates, a development device located at a development position, where the development device faces the image carrier, develops an electrostatic latent image formed on the image carrier, and when (i) the prediction unit has detected that the state of any of the development devices or the state of any of the toner cartridges changes to a monitoring required state and (ii) each development device is located at the development position, the state detection unit of each development device detects the state of each development device or the state of the corresponding toner cartridge and the detected state is exchanged between the first electrode associated with the state detection unit of each development device and the second electrode.

7. The apparatus according to claim 6, wherein:

the state of each development device to be detected by the corresponding state detection unit includes at least one of a concentration of the toner in each development device, attribute information of each development device, and information as to whether or not each development device is attached to the rotary unit, and the state of each toner cartridge to be detected by the corresponding state detection unit includes at least one of an amount of the toner remaining in each toner cartridge and information as to whether or not each toner cartridge is attached to the corresponding development device.

8. An image forming apparatus comprising:

a rotary unit that includes:

a plurality of development devices provided around a rotary shaft of the rotary unit, each development device comprising a state detection unit;

a plurality of toner cartridges that store toner and are detachably attached to the development devices; respectively, wherein each state detection unit detects a state of the corresponding development device or a state of the corresponding toner cartridge;

an image carrier;

a main body;

first electrodes that are associated with the state detection units, respectively;

a second electrode provided on the main body; and prediction units that correspond to the development units, respectively, each prediction unit that predicts the state of the corresponding development device or the state of the corresponding toner cartridge, wherein:

the plurality of development devices sequentially move as the rotary unit rotates, a development device located at a development position, where the development device faces the image carrier, develops an electrostatic latent image formed on the image carrier, and when (i) any of the prediction units has detected that the state of the corresponding development devices or the state of the corresponding toner cartridges changes to a monitoring required state and (ii) the corresponding development device is located at the development position, the state detection unit of the corresponding development device detects the state of the corresponding development device or the state of the corresponding toner cartridge and the detected state is exchanged between the first electrode associated with the state detection unit of the corresponding development device and the second electrode.

9. The apparatus according to claim 8, wherein:

the state of each development device to be detected by the corresponding state detection unit includes at least one of a concentration of the toner in each development device, attribute information of each development device, and information as to whether or not each development device is attached to the rotary unit, and the state of each toner cartridge to be detected by the corresponding state detection unit includes at least one of an amount of the toner remaining in each toner cartridge and information as to whether or not each toner cartridge is attached to the corresponding development device.

* * * * *